US006322663B1

(12) United States Patent
Müller et al.

(10) Patent No.: US 6,322,663 B1
(45) Date of Patent: Nov. 27, 2001

(54) CONFIGURATION FOR CLOSING ENVELOPES

(75) Inventors: Dietrich Müller; Detlef Lüdtke, both of Berlin (DE)

(73) Assignee: Francotyp-Postalia AG & CO, Birkenwerder (DE)

( * ) Notice: Subject to any disclaimer, the term of this patent is extended or adjusted under 35 U.S.C. 154(b) by 0 days.

(21) Appl. No.: 09/477,888

(22) Filed: Jan. 5, 2000

(30) Foreign Application Priority Data

Jan. 5, 1999 (DE) ..... 199 00 686

(51) Int. Cl.[7] ..... B43M 3/00
(52) U.S. Cl. ..... 156/441.5; 156/578
(58) Field of Search ..... 156/350, 441.5, 156/578; 118/32, 264

(56) References Cited

U.S. PATENT DOCUMENTS

| | | | | |
|---|---|---|---|---|
| 4,372,416 | * | 2/1983 | Denzin et al. | 156/441.5 |
| 4,850,580 | * | 7/1989 | Denzin | 271/2 |
| 4,926,787 | | 5/1990 | Fassman et al. | 118/32 |
| 4,932,188 | | 6/1990 | Krasuski et al. | 53/64 |
| 5,684,706 | | 11/1997 | Harman et al. | 364/464.16 |
| 5,809,752 | | 9/1998 | Holbrook | 53/569 |
| 5,949,444 | | 9/1999 | Geserich et al. | 347/4 |

FOREIGN PATENT DOCUMENTS

| | | |
|---|---|---|
| 2 324 182 | 11/1973 | (DE) . |
| 197 05 089 C1 | 3/1998 | (DE) . |
| 197 11 997 A1 | 9/1998 | (DE) . |
| 197 42 893 A1 | 4/1999 | (DE) . |
| 0 352 693 A1 | 1/1990 | (EP) . |
| 0 788 073 A2 | 8/1997 | (EP) . |

OTHER PUBLICATIONS

German Design Patent M9609167.3, dated Oct. 22, 1996.

* cited by examiner

*Primary Examiner*—James Sells
(74) *Attorney, Agent, or Firm*—Herbert L. Lerner; Laurence A. Greenberg; Werner H. Stemer

(57) ABSTRACT

A mail processing system has an envelope-separating apparatus with a moistening apparatus for moistening and discharging an envelope in an open state. A franking device is disposed downstream of the envelope-separating apparatus and is optionally provided with weighing scales. In the franking device a moistened glued edge of the envelope flap is pressed against the envelope pocket by pressure-exerting elements also serving for transporting the envelope. A closing module is disposed downstream of the franking device and has a closing-roller pair that is configured in a manner adapted for mixed-mail operation. Because the entire sequence in the franking device takes place between the stages where the glued edge is moistened and the envelope is closed, sufficient time is gained, even at high transporting speeds, in order for the glue to begin to dissolve sufficiently and for the envelope to be reliably closed.

20 Claims, 9 Drawing Sheets

CONFIGURATION FOR CLOSING ENVELOPES

BACKGROUND OF THE INVENTION

Field of the Invention

The invention relates to a configuration for closing envelopes in a mail-processing system once the glued edges of the envelope flaps have been moistened.

Mail-processing systems usually contain a letter/envelope-separating apparatus, in which the letters/envelopes are positioned in a stackwise manner, separated and closed as required. Downstream of this a franking and/or addressing machine with optional weighing scales, and a depositing apparatus are disposed (see German Geschmacksmuster DE 96 09 167.3 in the German Patent Office Design Journal dated 24.05.1997, Part 1a, goods class 18/02). The configuration according to the invention serves for reliably closing envelopes which run through such mail-processing systems.

A franking machine with devices for moistening the glued closing edges of the flaps of envelopes and then for closing the same is known, see Published, Non-Prosecuted German Patent Application DE 23 24 182 A1. The moistening apparatus for this essentially contains a water tank and a supporting arm along with a wick.

The envelopes are stacked such that the flaps are open. The flaps are turned against the envelopes by devices that are not described in any more detail. The envelopes rest flat on a table and are transported along the moistening apparatus by a transporting belt, which projects some way through a longitudinal slot in the table. In this case, the flaps of the envelopes are guided beneath the table.

The moistening apparatus is likewise disposed beneath the table, an open edge section of a supporting arm being located parallel, and transversely, to the table. The flap is pressed against the exposed section of the wick by a resiliently configured moistener casing, with the result that at least the glued closing edge is moistened as it passes.

The flap then passes through an opening in the table and, as the envelope runs through, the flap is pressed against the envelope by a pressure-exerting plate and a pressure mount feed plate, the envelope thus being sealed.

This apparatus allows only a relatively low transporting speed of horizontally located envelopes, since otherwise the capillary action from moistening the flaps is no longer sufficient. Added to this is the fact that the period of time from moistening up until the envelopes are closed is very brief. This results in the risk that the envelope glue does not begin to dissolve sufficiently in the moistening liquid and, consequently, the envelope is not reliably closed.

Meanwhile, the prior art already includes an apparatus which is intended for moistening the glued edges of the flaps of the envelopes and is the constituent part of a letter/envelope-separating apparatus.

SUMMARY OF THE INVENTION

It is accordingly an object of the invention to provide a configuration for closing envelopes that overcomes the above-mentioned disadvantages of the prior art devices of this general type, in which the application area and the functional reliability are increased.

With the foregoing and other objects in view there is provided, in accordance with the invention, a configuration for closing envelopes in a mail-processing system, including:

an envelope-separating apparatus having a moistening apparatus for moistening a glued edge of an envelope flap of an envelope and discharging the envelope in an open state with a moistened glued edge;

a franking device disposed downstream of the envelope-separating apparatus and receiving the envelope, the franking device having pressure-exerting elements for pressing the envelope flap with the moistened glued edge partially against an envelope pocket, the pressure-exerting elements further serving for transporting the envelope; and a closing module with a closing-roller pair disposed downstream of the franking device and receiving the envelope.

The object of the invention is to provide a configuration of the type mentioned in the introduction in the case of which the envelopes can be transported at a high transporting speed and nevertheless reliably be closed and carefully deposited in a stackwise manner without any follow-up work by hand being necessary.

Since the envelopes are moistened on the glued edges immediately after they have been separated and are only fully closed immediately before they are deposited, this ensures, despite a high transport speed, sufficient time for softening the glued edges and, consequently, a reliable closure of the envelopes.

In specific terms, the fact that the pressure-exerting elements, originally provided just for transporting purposes, are utilized for partially closing the envelopes and that the actual closing operation is carried out by a specifically configured closing module with a closing-roller pair at the end of the mail-processing system. The closing module provides, despite a high transport speed, a sufficient amount of time for the glue to soften and thus a reliable closure of the envelopes.

The configuration of a runner-like pressure-exerting lever and the mounting of the input-driven closing roller, and also the positioning of the spindles of the closing-roller pair, result in that even thick envelopes are closed without creases and folds being formed.

Moreover, the closing-roller pair also assists in depositing the envelopes in the depositing box in a functionally appropriate manner since the run-through speed of the envelopes in this region is adjusted to be at least equal to or greater than that in the printing region of the franking/addressing machine.

Other features which are considered as characteristic for the invention are set forth in the appended claims.

Although the invention is illustrated and described herein as embodied in a configuration for closing envelopes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
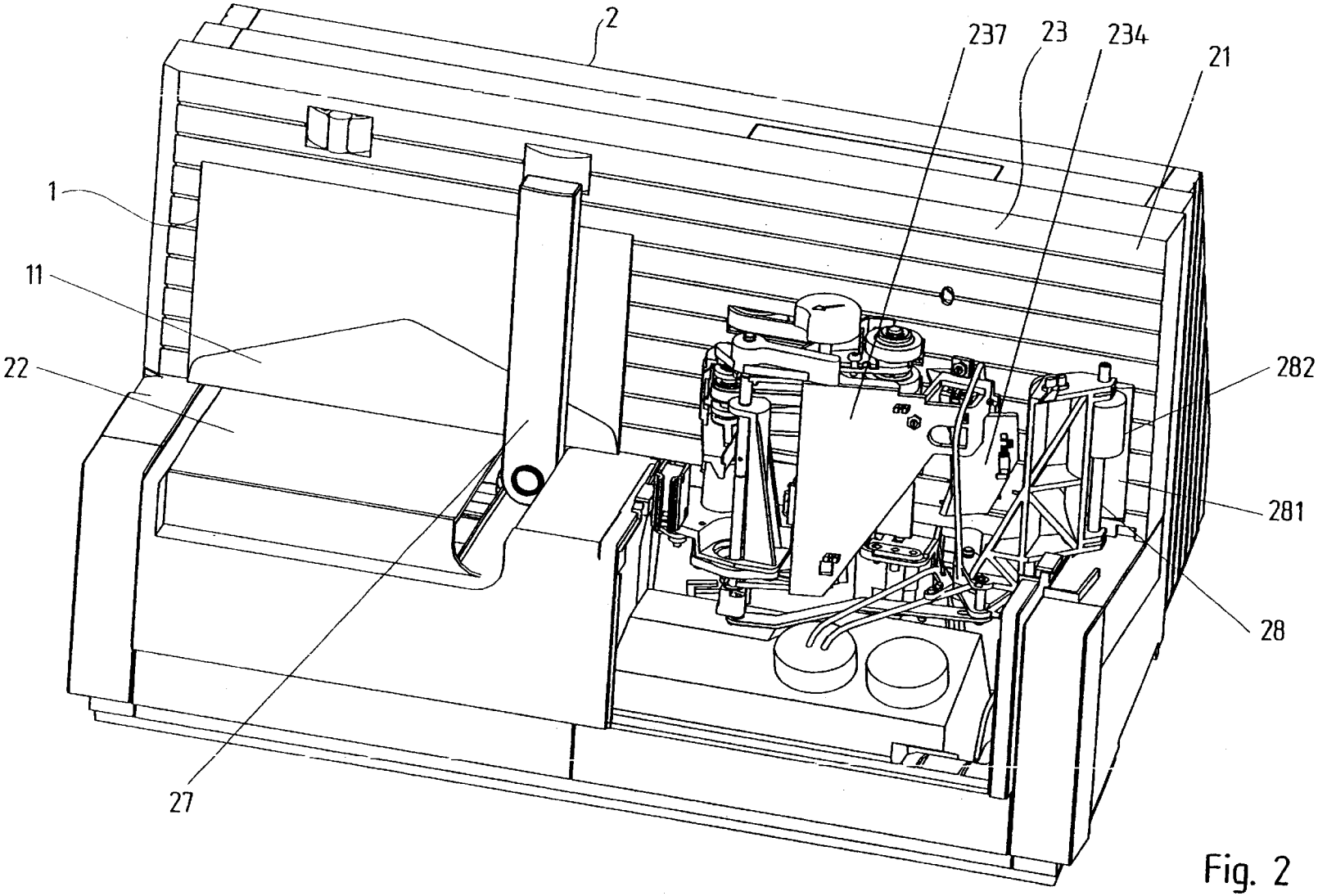
Fig. 2 Prior Art
FIG. 2 is a perspective, partly cut-away view of a letter/envelope-separating apparatus with a moistening device according to FIG. 1.

In all the figures of the drawing, sub-features and integral parts that correspond to one another bear the same reference symbol in each case. Referring now to the figures of the drawing in detail and first, particularly, to FIG. 2 thereof, there are shown envelopes 1 that are disposed as a stack, standing with an edge of an envelope flap 11 on a bottom guide plate 22, between a pressure-exerting bracket 27 and a rear guide plate 21 in a force-fitting manner of an envelope/letter separating apparatus 2. In this case, the envelope flap 11 is directed upward. The envelopes 1 are transported away from the stack laterally and, in the process, butt against the slightly inclined rear guide plate 21. In a movement path of the envelopes 1, there is disposed in a resiliently adjustable manner a guide unit 23 which is intended for the envelope flap 11 and, on an outlet side, has a device 234 for moistening the glued edge.

Provided on the outlet side is an ejecting-roller pair 28 which is made up of an input-driven, stationary ejecting roller 281 and an output-driven, resiliently adjustable ejecting roller 282. The output-driven ejecting roller 282 is shorter than the input-driven ejecting roller 281 by more than the maximum flap height of the envelopes, and is disposed flush at the top with the latter.

In this way, the envelopes leave the envelope-separating apparatus 2 with the glued edge moistened but still in an open state (i.e. the envelope is not glued shut).

Figure 3:
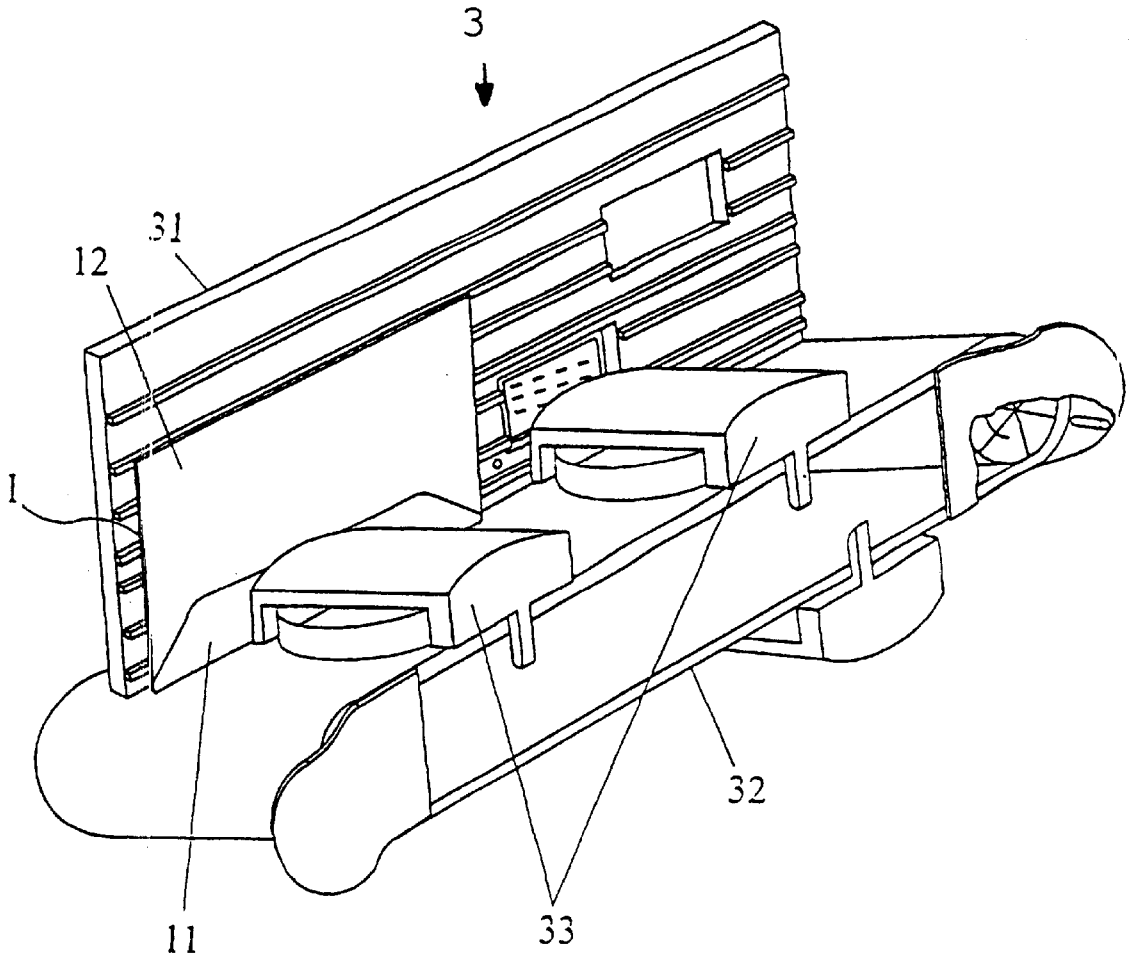
Fig. 3 Prior Art
FIG. 3 is a perspective view of a pressure-exerting region of a franking machine according to FIG. 1.

Also known is an apparatus for printing a printing substrate standing on one edge, in particular the envelope 1 in a franking and/or addressing machine 3, the printing substrate 1 being guided in a supported manner on an edge during the transporting operation and the printing operation, see Published, European Patent Application EP 0 788 073 A2 and FIG. 3.

In FIG. 3, the franking machine 3 has a guide plate 31, which is inclined in relation to the vertical and is intended for a slidable abutment of the envelope 1, and a circulating transporting belt 32 for applying an advancement force to the envelope 1 for advancement along the guide plate 31. Fastened on the transporting belt 32 are pressure-exerting elements 33 for pressing the envelope 1 onto the guide plate 31. The pressure-exerting elements 33 are disposed such that they can be moved toward the guide plate 31 and away from the same, such that, during the transportation and the printing operations, the envelope 1 is gripped in a force-fitting manner by the pressure-exerting elements 33 on a side of the envelope that is directed away from the guide plate 31.

Figure 1:
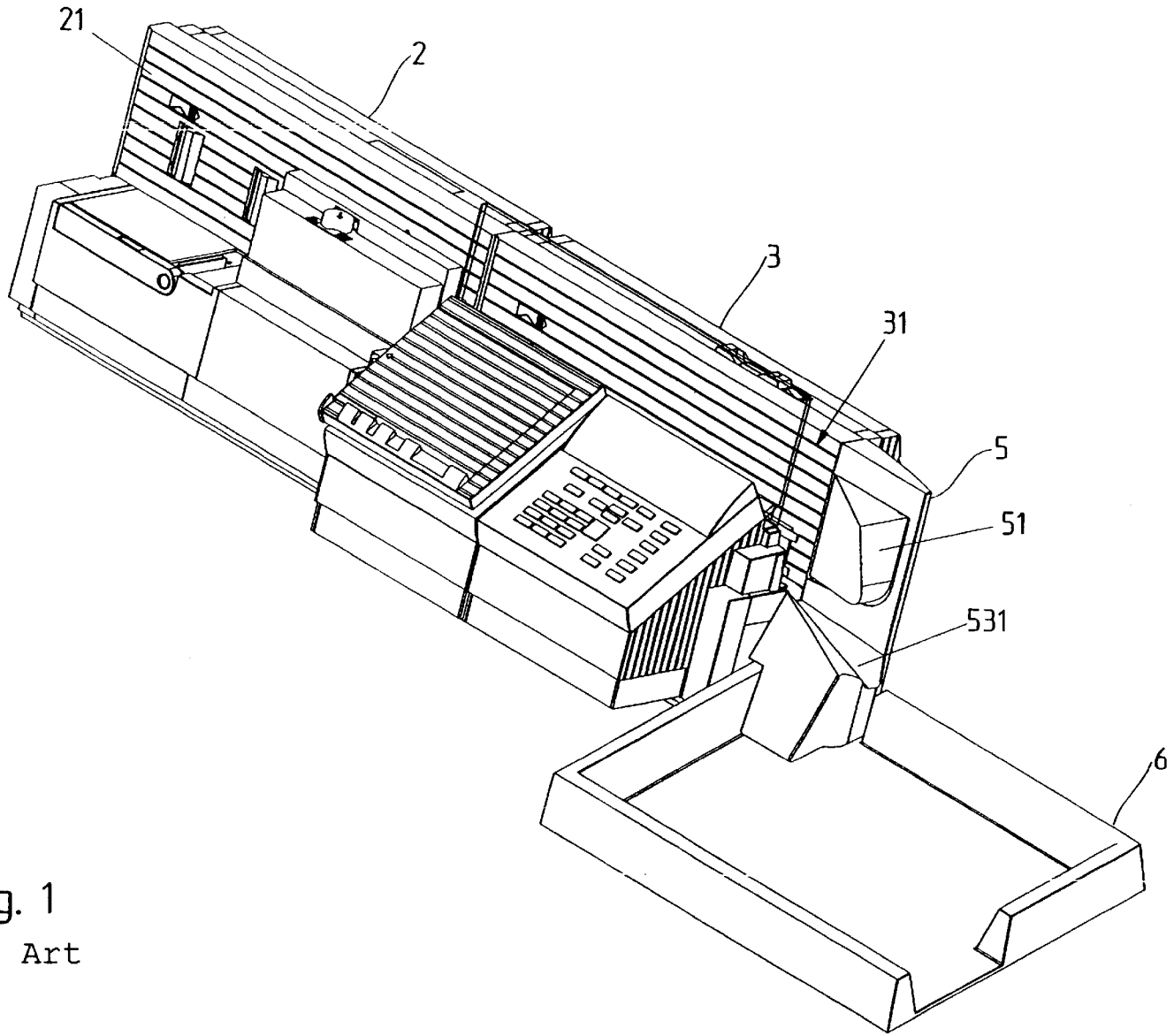
Fig. 1 Prior Art
FIG. 1 is a diagrammatic, perspective view of a mail-processing system according to the prior art.

Finally, a configuration in which it is possible to deposit envelopes for the above-mentioned franking machine 3 and in the case of which the envelopes are deposited in a stackwise manner one above the other in an adjusted box is also known, see German Patent DE 197 05 089 C1 and FIG. 1.

According to FIG. 1, the configuration contains an insert 5 and a box 6. These two form the termination of a mail-processing system, which also contains the letter/envelop-separating apparatus 2 and the franking machine 3.

The insert 5 is connected releasably to the franking machine 3, which, adjoining the guide surface for a bottom edge of the envelope 1 in the franking machine 3, has a channel 531, which slopes down in the transporting direction, and a pivotable, resilient rocker SI parallel to a front edge of the insert 5.

At the same time, in the left-hand rear corner region of the box 6, the insert 5 is placed at a small distance from the same, the two being adapted to one another.

Figure 4:
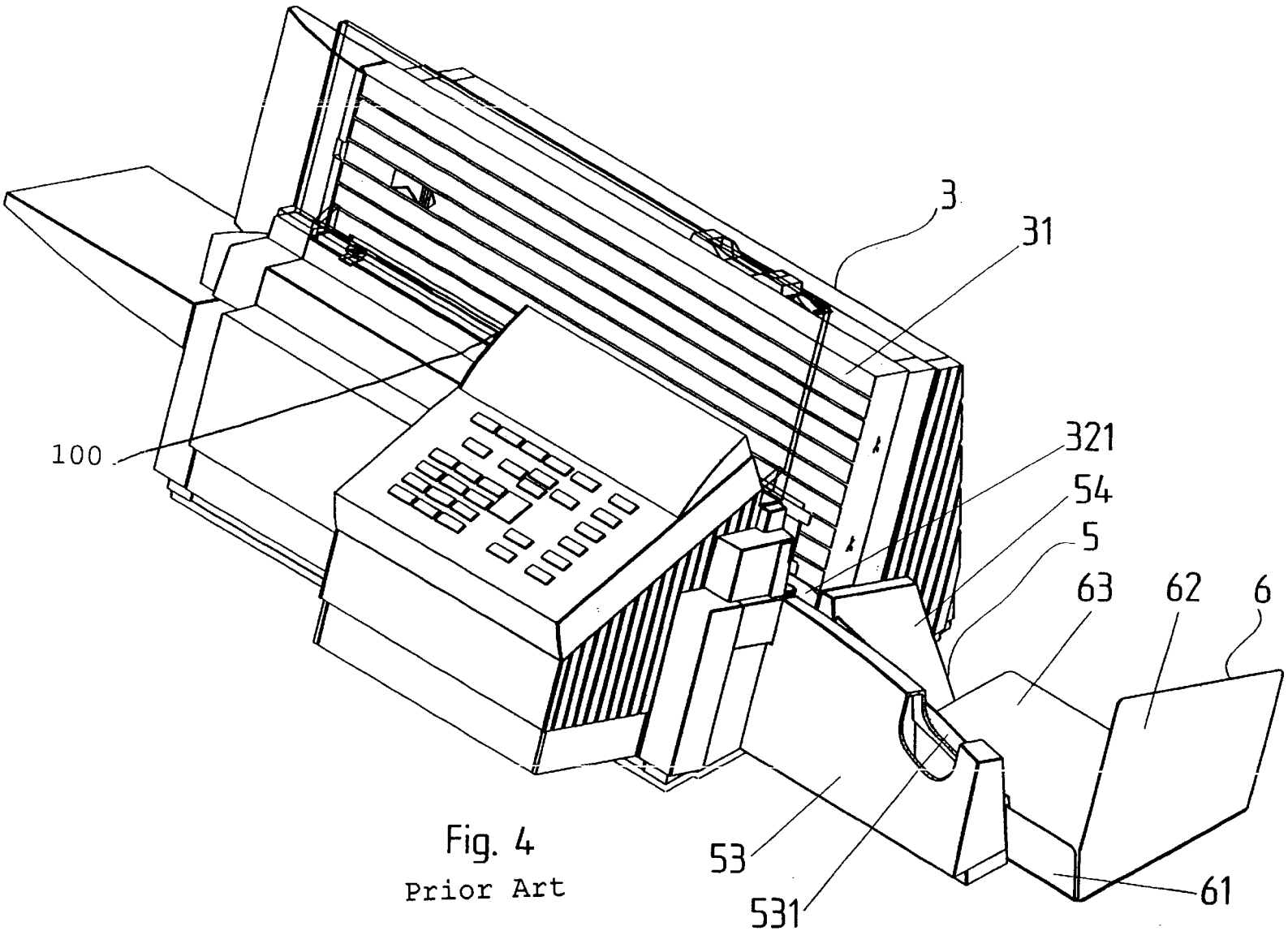
Fig. 4 Prior Art
FIG. 4 is a perspective view of the franking machine with a configuration in which it is possible to deposit envelopes according to the prior art.

As a supplement to the above-mentioned depositing apparatus, the prior art as shown in FIG. 4 has also been found to include a solution in which the angled insert 5 is attached to the franking machine 3 by way of its side wall 54, and has the downwardly sloping channel 531 formed in its front wall 53, and the open angled box 6 is guided adjustably by way of its front wall 61.

The channel 531 adjoins the guide plane for the bottom edge of the letter/envelop in the franking machine 3. The side wall 62 of the box 6 is configured as a resilient deflecting wall and is disposed at an adjustable distance downstream of the channel 531 and orthogonally to the transporting direction.

The distance between the side wall 62 and the outlet of the franking machine 3 is adjusted to be somewhat greater than the largest letter format which is to be processed.

Optionally, the franking device 3 shown in FIG. 4 has a weighing scale 100 for weighing the envelope 1 for determining the postage.

With a mail-processing system which is made up of the four last-mentioned devices (FIGS. 1–4)—it being possible to chose one of two optional depositing apparatuses—the envelopes 1 will be closed more or less appropriately on account of the weight of the stack, in which the envelopes are located one above the other. In this device it is possible to avoid the situation where at least the envelopes 1 at the top of the stack have to be closed by hand. In mail-processing systems with throughput figures of 5000 envelopes and above, this situation is not satisfactory.

Figure 5:
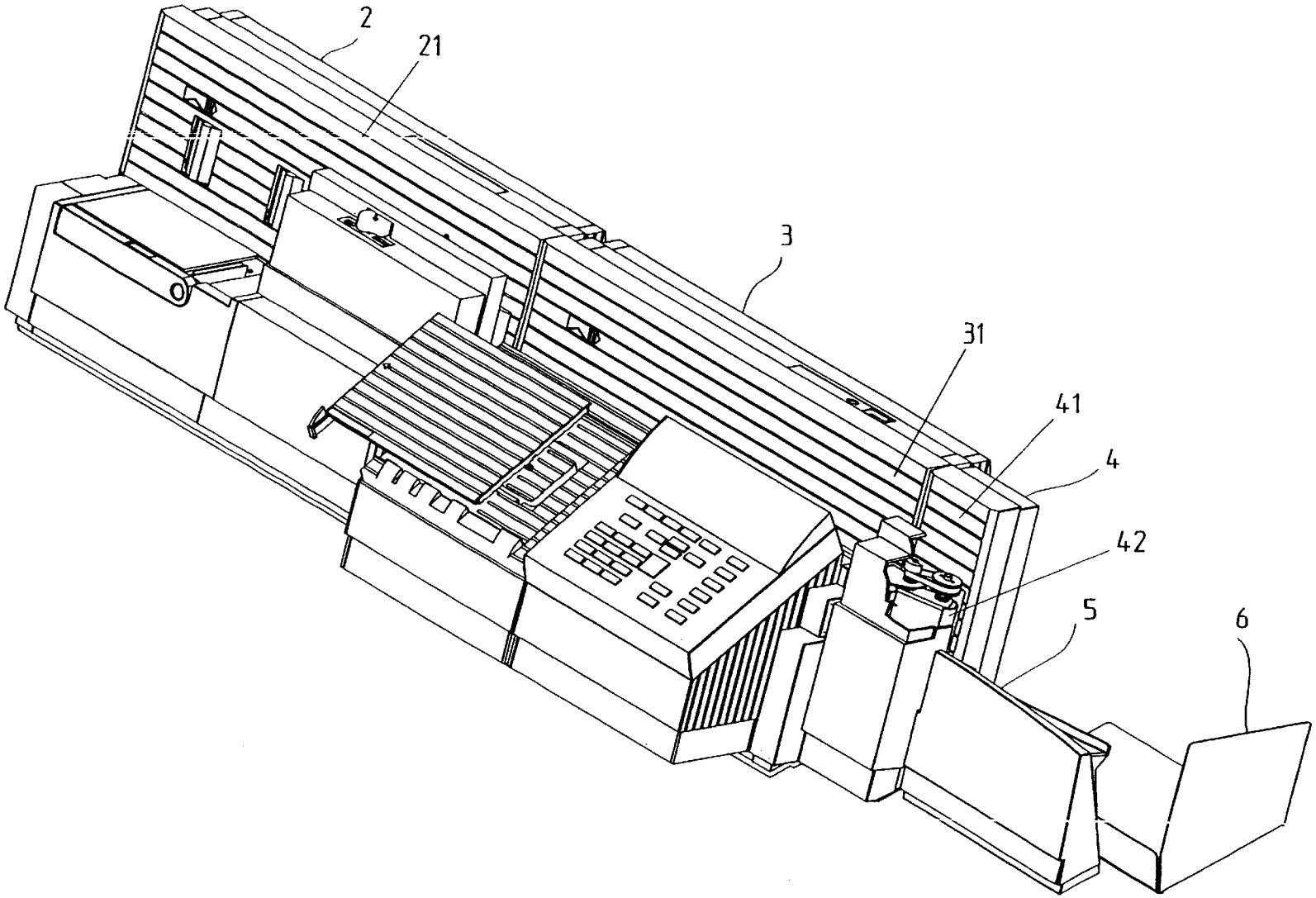
FIG. 5 is a perspective view of the mail-processing system with a configuration according to the invention.

In FIG. 5, a closing module 4 is added in between the franking machine 3 and the insert 5 with the depositing box 6. The essential constituent part of the closing module 4 is a closing-roller pair 42 containing an input-driven closing roller 421 and an output-driven closing roller 422 (see FIG. 6). The closing module 4 is attached to the franking machine 3 such that its guide plate 41 forms a continuation of the guide plate 31 of the franking machine 3, which in turn constitutes a continuation of the guide plate 21 of the letter/envelope-separating apparatus 2. In other words, all three guide plates 21, 31 and 41 are in alignment.

The envelopes 1 pass into the franking machine 3 from the separating apparatus 2 in the open state, but with the moistened envelope flap 11 disposed in front of an envelope pocket 12. The envelope flaps 1 are gripped in a force-fitting manner, in the franking machine 3, by the pressure-exerting elements 33 for transportation in the franking machine 3 (see FIG. 3), and are partially closed in the process, and, following the franking, are transferred to the closing module 4 and are fully closed in the latter by the closing-roller pair 42.

For this purpose, the pressure-exerting elements 33 extend up to such a height, and the closing rollers 421, 422 are of such a length, that the envelope flaps 11 are gripped fully over a maximum height of the envelope flaps 11.

In the closing module 4, the letter-transporting speed is adjusted to be somewhat higher—up to 13%—than in the printing region of the franking machine 3. The adjoining insert 5 with the depositing box 6 is accordingly adapted and optimized.

The maximum stacking depth in the envelope-separating apparatus 2 and a height of the transporting plane in the same, and accordingly also in the franking machine 3, are coordinated with one another such that, when the largest possible stack of letters is being processed from the separating apparatus 2, the maximum possible stacking height in the depositing box 6 that corresponds more or less to the top edge of the channel 531—is not exceeded.

Figure 6:
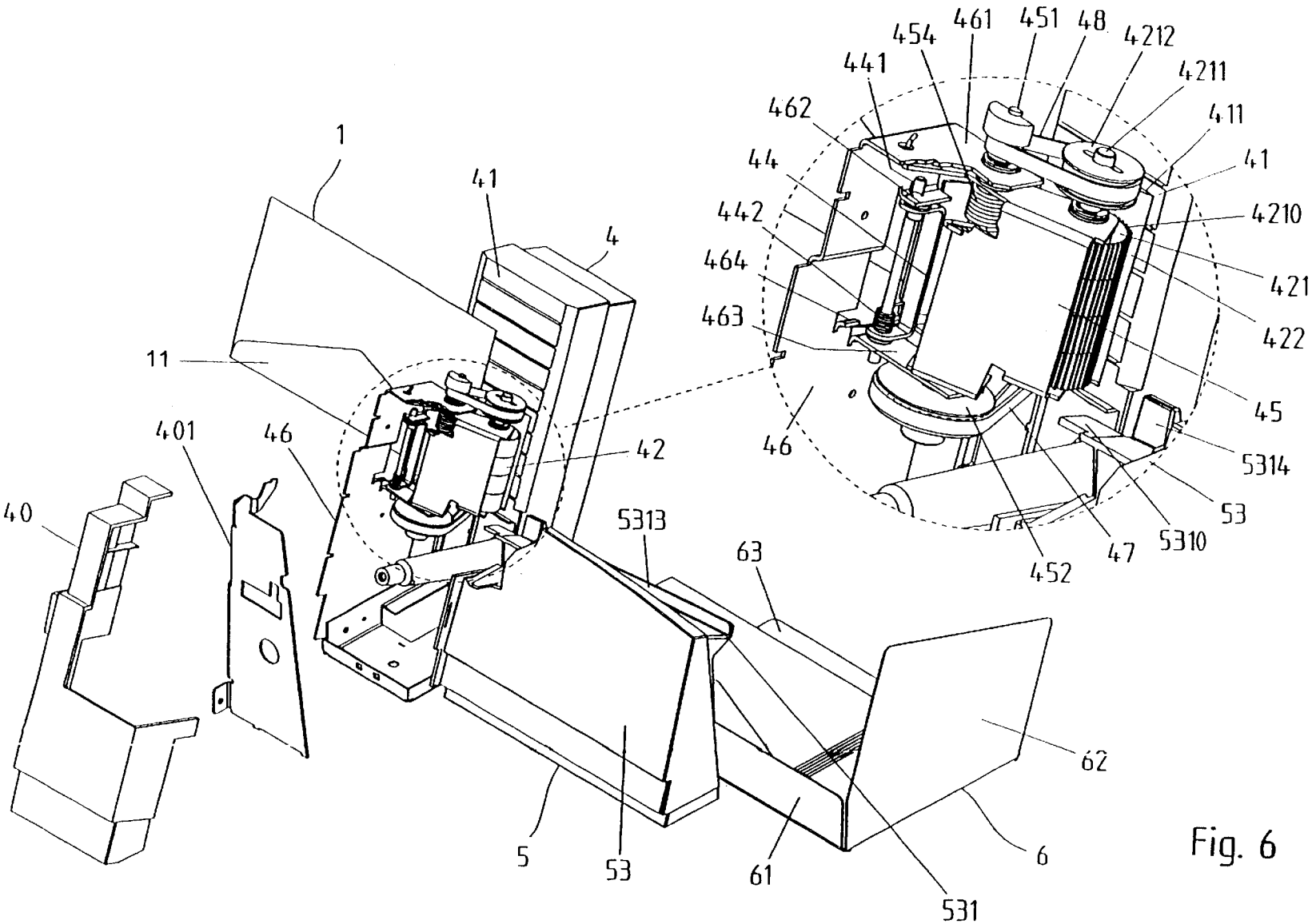
FIG. 6 is a partly exploded, perspective view relating to a closing region according to FIG. 5.

It can be seen in FIG. 6 how the closing module 4, the insert 5 and the depositing box 6 are connected to one another and the envelopes/letters run through within these structural units. The envelope 1 passes from the franking machine 3 into the closing module 4 and is guided by a wedge-shaped narrowing to the two closing rollers 421, 422. The wedge-shaped narrowing is formed, toward a front side, by a toothed belt 48 and, at the rear, by the guide plate 41, see also FIG. 8.

The envelope 1 passes first of all into a region of a resiliently mounted, runner-like pressure-exerting lever 44. A free end of the pressure-exerting lever 44 is spaced apart from the guide plate 41 by a small distance—about 5 mm with the result that thin envelopes can pass through the pressure-exerting lever 44 without obstruction. In the case of thick envelopes 1, the pressure-exerting lever 44 butts against the same right from the beginning, with the result that the envelope flap 11 is positioned against the pocket 12 of the envelope 1.

Following passage through the pressure-exerting lever 44, the envelopes 1 pass onto the toothed belt 48. Via the toothed belt 48, the envelope 1 is directed to the guide plate 41 and then, between the closing rollers 421, 422, is pushed with contact pressure onto the channel 531 in the insert 5 in order to tip from the channel 531, via rear guide slopes 5313, into the depositing box 6.

The channel 531 runs horizontally in adaptation to the plane on which the envelopes 1 stand in the franking machine 3 and the horizontal guidance of the envelopes in the closing module 4.

On account of the inclination of the guide plate 41 and of the parallel configuration of the closing rollers 421, 422 in relation to the guide plate 41, the envelopes 1 have a clearly predetermined orientation, this ensuring that they are deposited in the direction of the depositing box 6. The envelopes 1 are stacked one above the other on a base of the depositing box 6. The right-hand side wall 62 prevents the envelopes 1 from moving out laterally. A front wall 61 of the depositing box 6 is guided in a slit 532 (se e also FIGS. 9*a* and 9*b*) of the front wall 53 of the insert 5 such that it can be adjusted in accordance with the largest letter/envelope format which is to be processed in each case.

The closing module 4 is attached by way of its left-hand side wall 46, in the region of the guide plate 41, to the right-hand side wall of the franking machine 3. The closing module 4 has, in a front region, a front covering 40 for the closing-roller pair 42 and a reinforcing angle 401 for inner support.

In an inlet region for the envelopes 1, the side wall 46 is provided with an angled lug 460 for guiding the envelopes 1 at the bottom. Furthermore, the side wall 46 is configured as a retaining angle for the pressure-exerting lever 44 and its spindle 441 and for a carrying lever 45 and its spindle 451, and is provided with correspondingly angled lugs 461 to 464.

The spindle 441 for the runner-like pressure-exerting lever 44 is fastened in the parallel lugs 462 and 463. The pressure-exerting lever 44 is disposed, a small distance from the guide plate 41, such that it can be rotated against a spring 442 likewise pushed onto the spindle 441. The spring 442 is supported, at one end, on the pressure-exerting lever 44 and, by its other end, on the lug 464 of the side wall 46. The distance from the guide plate 41 may be dispensed with if the spring force is of correspondingly small dimension in an entry region.

The carrying lever 45 for the input-driven closing roller 421 is mounted in a resiliently rotatable manner on the spindle 451 which is fastened in the two parallel lugs 461 and 463. The carrying lever 45 is angled at top and bottom ends for the purpose of receiving the spindles 451 and 4211. A spring 454 is likewise pushed onto the spindle 451. The spring 454 is supported, by one end, on the carrying lever 45 and, by its other end, on the lug 461. Moreover, a gear wheel 452 is fastened at a bottom end of the spindle 451 and a pinion 453 is fastened at a top end of the spindle 451, see FIG. 7.

The spindle 4211, with the closing roller 421 fastened on it, is mounted rotatably in an outer pivot region of the carrying lever 45. A gear wheel 4212 is also fastened at a top end of the spindle 4211. The gear wheel 4212 is coupled kinematically to a pinion 453 on the spindle 451 by the toothed belt 48.

Figure 8:
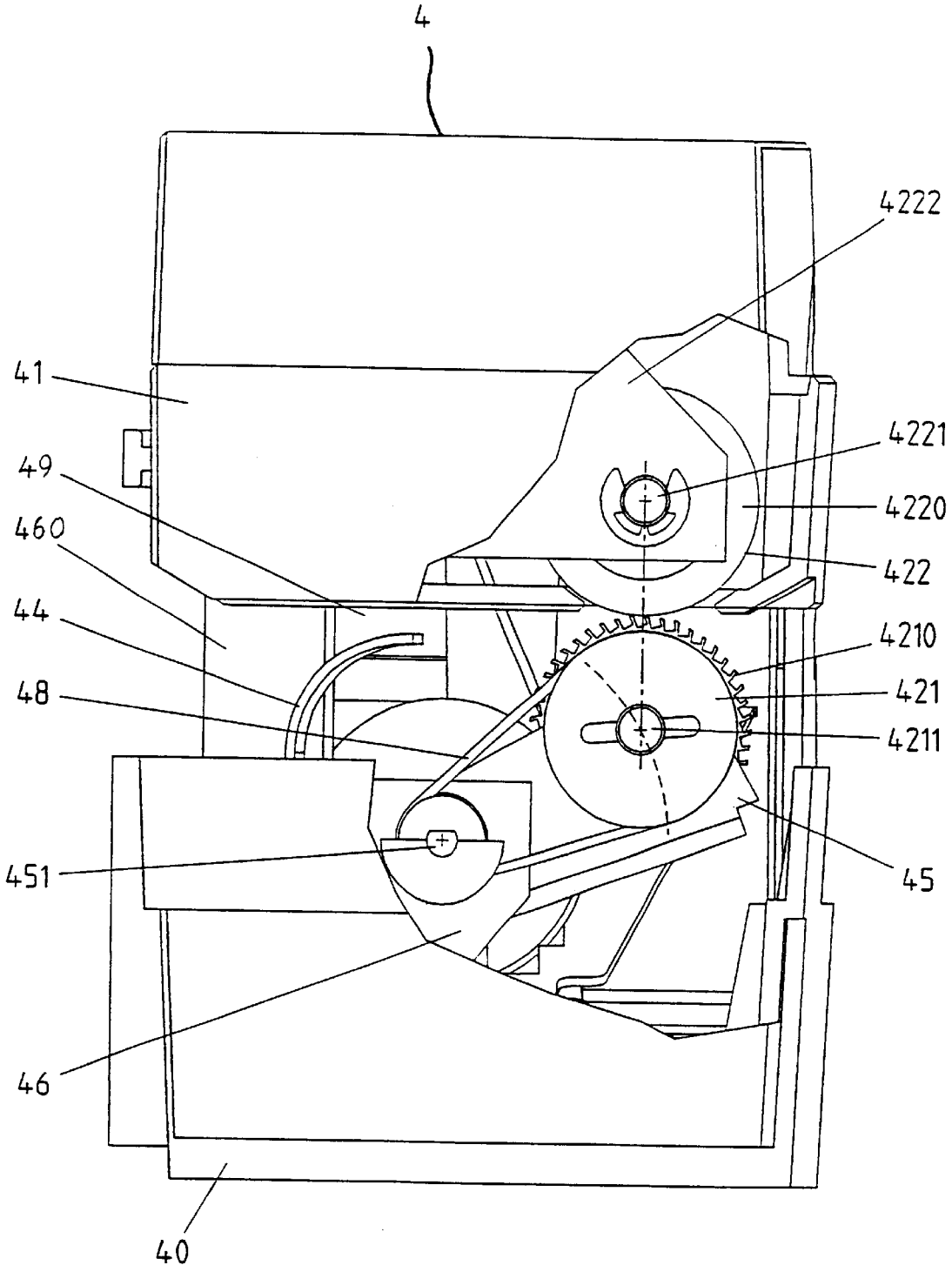
FIG. 8 is a partly broken-away, top plan view relating to a positioning of spindles of a closing-roller pair.

The output-driven closing roller 422 is disposed behind the guide plate 41, in an opening 411 of the same, such that the closing roller 422 is flush on the outside with a front plane—which, as is known, is the abutment plane for the envelope 1—of the guide plate 41, see also FIG. 8.

Figure 7:
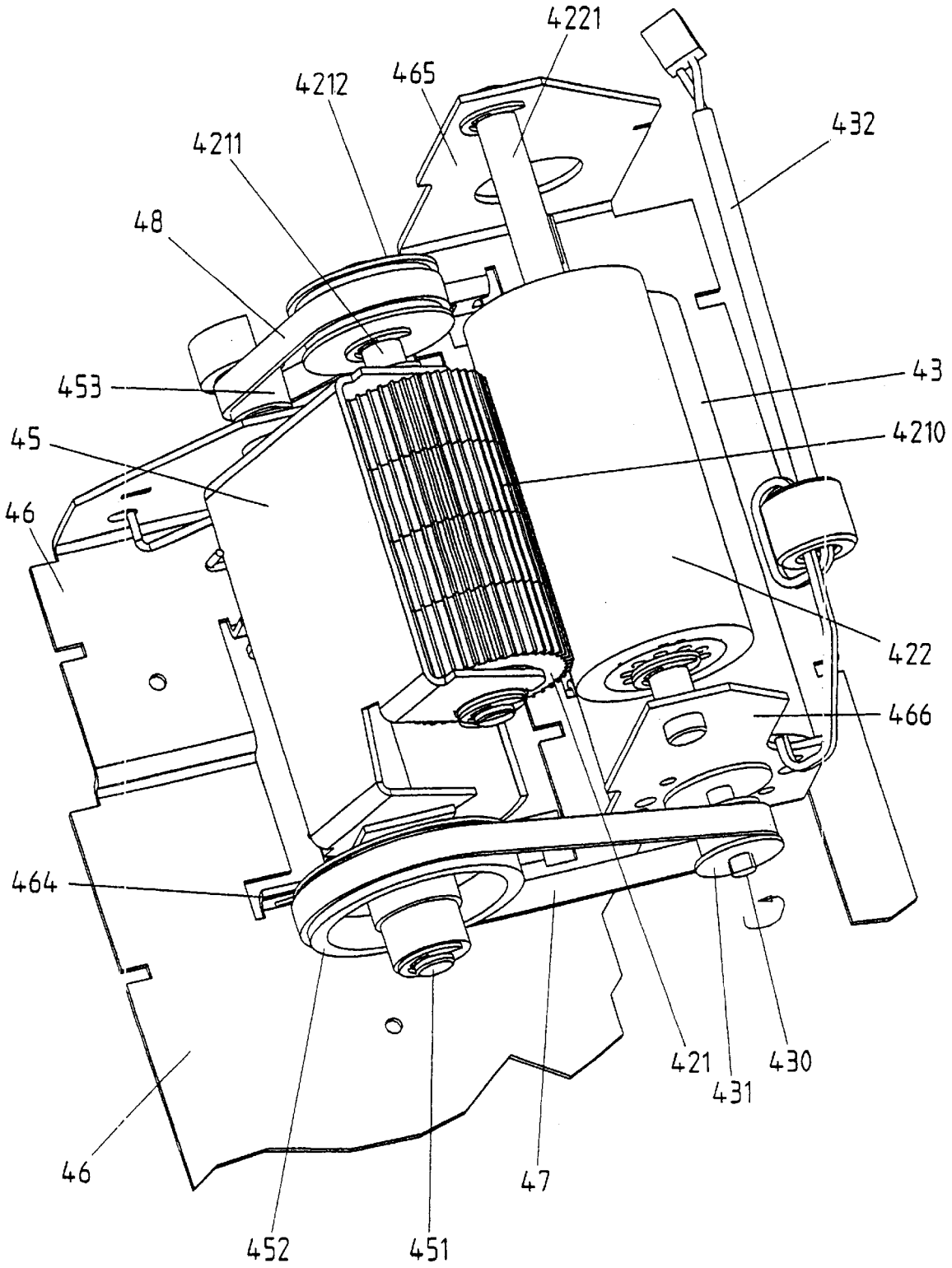
FIG. 7 is a perspective view of a drive in the closing region.

As can be seen in FIG. 7, the gear wheel 452 is coupled kinematically to a pinion 431 by a toothed belt 47. The pinion 431 is fastened on a spindle 430 of a motor 43, which is connected, via a power-supply line 432, to the same power source, and consequently also to the same control devices in the franking machine 3, which serves for driving the transporting belt 32, see also FIG. 3. In other words, when the transporting belt 32 operates, the closing rollers 421, 422 also rotate, to be precise such that the transportation in the closing module 4 is synchronous with, but somewhat quicker—more or less up to 13%—than, the transportation in the franking machine 3. This prevents any jamming.

The motor 43 is flanged onto a lug 466 of the side wall 46. A spindle 4221 of the output-driven closing roller 422 is fastened in the parallel lugs 46 S and 466. The closing roller 422 is disposed rotatably on the spindle 4221.

In the case illustrated, that is to say as seen from beneath, when the motor 43 is operating the pinion 431 is rotated in the counterclockwise direction and the movement is transmitted to the gear wheel 452 via the toothed belt 47. Since the gear wheel 452 is fixed on the spindle 451 and the latter can be rotated, the rotary movement of the gear wheel 452 is transmitted to the pinion 453 via the spindle 451, the pinion 453 likewise being fixed on the spindle 451. The pinion 453 drives the gear wheel 4212 via the toothed belt 48, the gear wheel 4212, together with the closing roller 421, being fixed on the rotatable spindle 4211. In this way, the closing roller 421 is then driven by the gear wheel 4212 via the spindle 4211.

The rotary movement of the input-driven closing roller 421 is transmitted to the other closing roller 422 in a force-fitting manner by friction via the envelope 1 or directly. In order to have favorable static friction, the input-driven closing roller 421, or the closing roller 421 which drives the envelope, has a grooved outer covering 4210, see also FIG. 8. In this case, the grooves run parallel to the spindle 4211 and have a shark-tooth-shaped contour. The elastic positioning of the teeth achieves both highly elastic adaptation to unevennesses in envelopes and an increase in the carry-along surface area and thus good adherence properties. The effect is increased further if a suitable silicone rubber is used.

For the outer covering 4220 for the output-driven closing roller 422, use is made of a flexible, highly absorbent foam rubber or open-microcell foamed polyurethane. In this way, the closing roller 422 acts as a blotting roller for pressure points which are still moist; smearing is thus avoided.

FIG. 8 shows the positions of the input-driven closing roller 421 and the output-driven closing roller 422 in relation to one another.

In the rest state, the two closing rollers 421, 422 butt against one another in an axis-parallel manner on a line which is orthogonal—chain-dotted—to the front side of the guide plate 41 and/or to the abutment plane for the envelope 1.

This state is also largely maintained for thin letters and envelopes.

As the envelope thickness increases, the carrying lever 45 for the closing roller 421 is rotated resiliently to the front side, in the forward direction, about its spindle 451. In this case, the spindle 4211 moves along over a circular path—dashed lines—with the result that the input-driven closing roller 421 comes to be located downstream of the output-driven closing roller 422, as seen in the transporting direction of the envelope 1. On the one hand, this results in the envelope 1 being bent slightly around the closing roller 422 by the closing roller 421, while, on the other hand, the runner-like pressure-exerting lever 44 acts as abutment. This enforced curvature of the envelope 1 achieves the situation where the envelope flap 11 is already positioned closely against the pocket 12 of the envelope 1 even before it passes through the closing-roller pair 42.

The output-driven closing roller 422 is somewhat longer than the input-driven closing roller 421 and is disposed such that the bottom edge is located at least at as low a level as the bottom edge of the envelope. The input-driven closing roller 421 is disposed such that its bottom edge is located at a somewhat higher level—more or less 5 mm—than the bottom edge of the letter. This achieves the situation where all the contact pressure acts, in the region of the glued edge, on the flap 11 of the envelope 1 and uneven or bumpy envelope contents do not have a disadvantageous influence on the gluing process.

In order to assist a successful closing operation further, the two closing rollers 421, 422 and their spindles 4211, 4221 are inclined slightly—that is to say less than 3°, preferably 1.7°—in the envelope-transporting direction. This avoids creases and folds from being formed in particular. This problem is difficult to solve particularly in the case of thick and partly irregularly filled envelopes. The positive effect is assisted further by the specific configuration of the outer covering 4210 of the input-driven closing roller 421.

The closing operation can also be adversely affected by the way in which envelopes are deposited. In particular when thickly filled envelopes 1 drop forcibly onto the edge or, worst still, onto a corner, there is the risk of the closure splitting open again. The insert 5 is configured appropriately in order to avoid this effect, and this is described here-in-below.

Figure 9A:
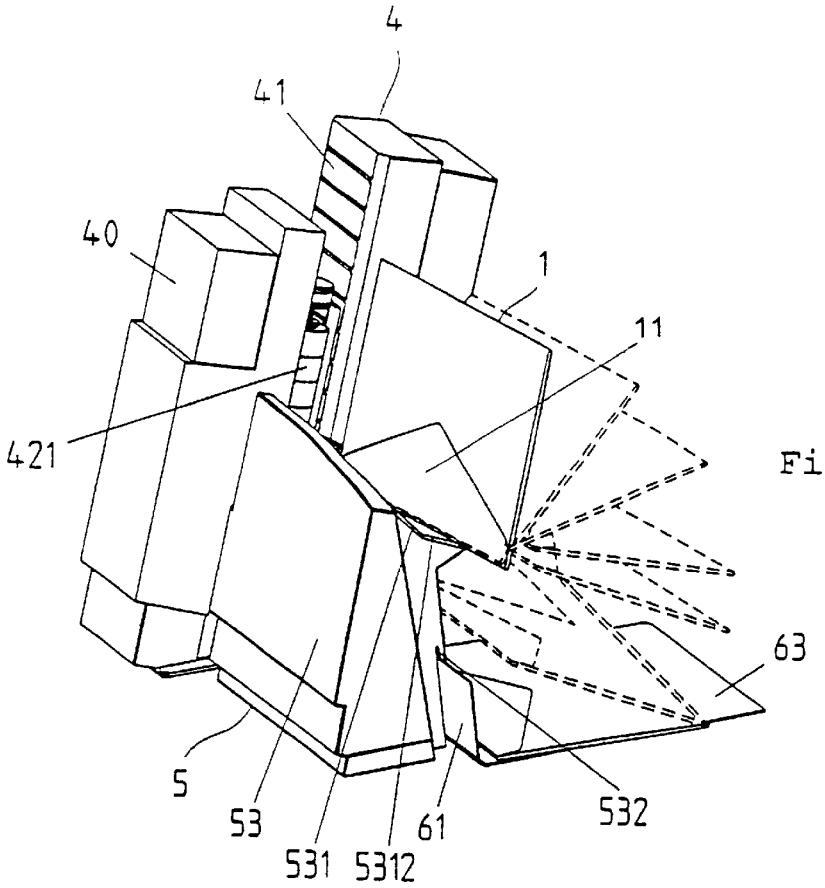
FIGS. 9*a* and 9*b* are perspective views of details relating to depositing envelopes and letters.
Figure 9B:
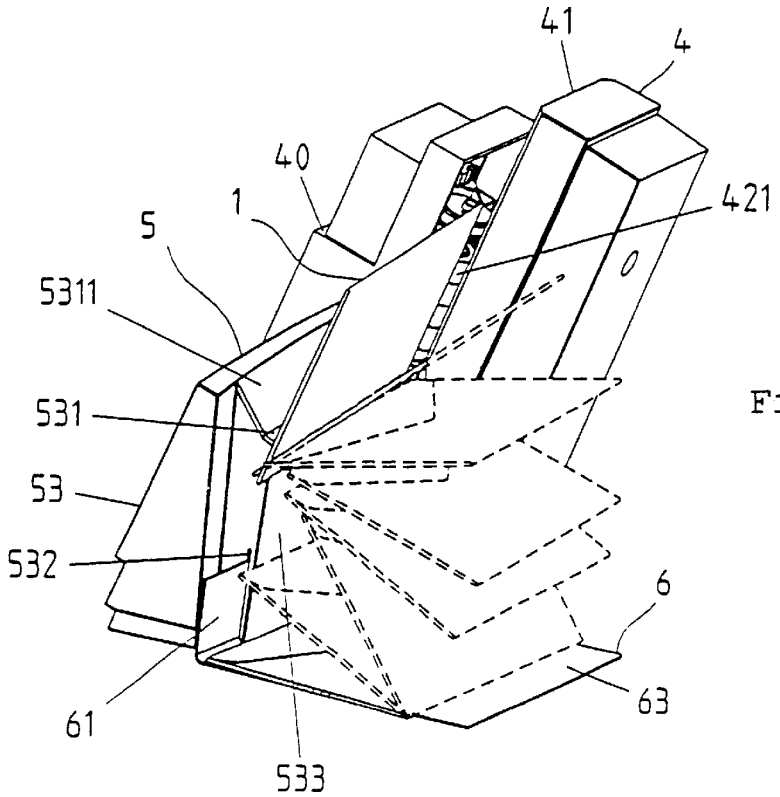

FIGS. 9*a* and 9*b* illustrate in more detail the construction of the insert 5 and the movement sequence of the envelopes 1 as they are deposited from the insert 5 into the depositing box 6. The configuration of the channel 531 and of the rear side 532 of the front wall 53 have particular influence here.

As has already been mentioned above, the channel 531 runs horizontally overall, but sloping slightly rearwardly, in the transporting direction behind the front plane of the guide plate 41.

At the entry, the channel 531 has a nose 5310 (FIG. 6) which projects beyond the side wall 54 of the insert 5 into the closing module 4. The nose 5310 is configured as a slanting plane which slopes down in the outward direction, in order to prevent the envelopes 1 from catching during transfer to the channel 531. The channel 531 also has at the entry, in a rear region, a supporting plate 5314 which is adapted to the inclination of the guide plate 41 in the closing module 4. The supporting plate 5314 prevents thin, light-weight envelopes 1 from fluttering about and, as a result, not being deposited correctly, see also FIG. 6.

The channel 531 has a front top guide slope 5311, a front bottom guide slope 5312 and a rear guide slope 5313. This gives, in transverse profile, a wedge-shaped depression that is bent on one side. An envelope 1 running into the channel 531 slides down to the base of the guide slopes 5311, 5312, 5313 to the extent permitted by the thickness of the envelope edge which is being placed in position.

A rear side 533 of the front wall 53 undercuts the channel 531 and/or the rear guide slope 5313.

When the entire envelope 1 has left the closing module 4, it tips via the rear guide slope 5313 first of all, in order then, by way of the edge which is located opposite the envelope flap 11, to come into contact, at an oblique angle, with the base 63 of the depositing box 6 or the previously deposited envelope 1. The envelope 1 then slides downward with the edge of the envelope flap 12 on the rear side 533 of the front wall 53.

In this way, the envelope 1 slides into the depositing box 6 and impact loading is thus avoided.

We claim:

1. A configuration for closing envelopes in a mail-processing system, comprising:

an envelope-separating apparatus having a moistening apparatus for moistening a glued edge of an envelope flap of an envelope and discharging the envelope in an open state with a moistened glued edge;

a franking device disposed downstream of said envelope-separating apparatus and receiving the envelope, said franking device having pressure-exerting elements for pressing the envelope flap with the moistened glued edge partially against an envelope pocket, said pressure-exerting elements further serving for transporting the envelope; and a closing module with a closing-roller pair disposed downstream of said franking device and receiving the envelope.

2. The configuration according to claim 1, wherein said franking device has at least one weighing scale.

3. The configuration according to claim 1, wherein:

said envelope-separating apparatus has a first inclined guide plate and an ejecting-roller pair, in said envelope-separating apparatus the envelopes are positioned in a stackwise manner against said first inclined guide plate with the envelope flap in front of the envelope pocket and the envelopes stand on an edge of the envelope flap with the envelope flap oriented in an upward direction, said envelope-separating device separating the envelopes and then moistening the glued edges of the envelopes before discharging the envelopes in the open state via said ejecting-roller pair to said franking device;

said franking device has a second inclined guide plate and the envelopes are transported with an aid of said pressure-exerting elements in said franking device such that the envelopes stand on the edge and butt against said second inclined guide plate, said pressure-exerting elements each have an engagement region for pressing the envelopes against said second inclined guide plate such that the envelope flap is pressed against the envelope pocket of the envelope at least partially in a region of the glued edge; and said closing module has a third inclined guide plate and a closing roller pair disposed parallel to said third inclined guide plate, and said closing module is configured for a mixed mail operation.

4. The configuration according to claim 3, including:

an insert connected to said closing module, said insert having a channel running slightly rearwardly in a horizontal direction and in which the envelopes slide along; and a depositing box connected to said insert for receiving the envelopes.

5. The configuration according to claim 1, wherein said envelope-separating apparatus has a first inclined guide plate, a transporting plane with a given depth, and an ejecting-roller pair, in said envelope-separating apparatus the envelopes are positioned in a stack against said first inclined guide plate with the envelope flap in front of the envelope pocket and the envelopes standing on an edge of the envelope flap with the envelop flap oriented in an upward direction, said envelope-separating apparatus separating the envelopes and then moistening the glued edge of the envelopes before discharging the envelopes in the open state via said ejecting-roller pair to said franking device, the stack of the envelopes has a maximum stacking depth and said depth of said transporting plane being at least of a same height as the maximum stacking depth;

wherein said franking device has a second inclined guide plate and a transporting belt, the envelopes are transported with an aid of said pressure-exerting elements in said franking device such that the envelopes stand on the edge and butt against said second inclined guide plate, said pressure-exerting elements being fastened on said transporting belt and disposed such that they can be moved resiliently toward and away from said second inclined guide plate, said pressure-exerting elements each have an engagement region for pressing the envelopes against said second inclined guide plate and are configured and disposed such that the envelope flap is pressed against the envelope pocket of the envelope at least partially in a region of the glued edge;

wherein said closing module has a third inclined guide plate and a closing roller pair disposed parallel to said third inclined guide plated, and said closing module is configured for a mixed mail operation;

including an insert connected to said closing module, said insert having a channel running slightly rearwardly in a horizontal direction and the envelopes slide along in said channel; and a depositing box connected to said insert, the envelopes are deposited in a stackwise manner in said depositing box.

6. The configuration according to claim 4, wherein:

said closing module is releasably attached to said franking device;

said insert is releasably attached to said closing module;

said depositing box is guided in said insert such that it can be adjusted along a transport path of the envelope; and said first, second and third inclined guide plates are adapted to one another.

7. The configuration according to claim 6, wherein said first, second and third inclined guide plates all have an inclination of 18° beyond vertical and are in alignment with one another.

8. The configuration according to claim 3, wherein said pressure-exerting elements of said franking device extend up to such a height that the glued-edge of the envelope flap is gripped at its maximum height.

9. The configuration according to claim 1, wherein said closing-roller pair includes an input-driven closing roller disposed resiliently and pivotably in front of said third inclined guide plate, and an output-driven closing roller disposed in a stationary manner behind said third inclined plate, said third inclined guide plate having a front side and an opening formed therein and said output-driven closing roller projecting through said opening in said third inclined guide plate to such an extent that it terminates flush with said front side of said third inclined guide plate.

10. The configuration according to claim 9, wherein:

said input-driven closing roller and said output-driven closing roller are each of such a length that the envelope flap is gripped fully over a maximum height of the envelope;

said output-driven closing roller is longer than said input-driven closing roller;

said output-driven closing roller has a bottom edge disposed at least at as low a level as a bottom edge of the envelope; and said input-driven closing roller has a bottom edge disposed approximately 5 mm higher than the bottom edge of the envelope.

11. The configuration according to claim 9, wherein said closing module has a runner-like resiliently pivotable pressure-exerting lever having a free end and disposed upstream of said closing-roller pair and counter to an envelope transporting direction, said free end, even in a rest position, is spaced apart from said third inclined guide plate by a distance greater than an average thickness of the envelopes.

12. The configuration according to claim 9, wherein:

said closing module has a first spindle for mounting said output-driven closing roller;

said closing module has a resiliently rotatable carrying lever with a free end and a second spindle for mounting said input-driven closing roller at said free end of said resiliently rotatable carrying lever such that said input-driven closing roller can be deflected away from said third inclined guide plate in accordance with a thickness of the envelope, such that, with an increasing deflection, said second spindle being parallel to said first spindle is disposed downstream in relation to said first spindle as seen in the envelope transport direction; and said first and second spindles are inclined slightly in the envelope transport direction.

13. The configuration according to claim 9, wherein:

said closing module has a spindle mounting said input-driven closing roller;

said input-driven closing roller has an outer covering formed with grooves defining a shark-tooth-shaped contour made of silicone rubber, said grooves running parallel to said spindle of said input-driven closing roller; and said output-driven closing roller has a smooth outer covering made of an open-microcell foamed polyurethane.

14. The configuration according to claim 9, wherein:

said closing module has a drive for driving said input-driven closing roller, said drive including:

a first rotatable spindle;

a first gear wheel mounted on said first rotatable spindle;

a first pinion;

a first toothed belt deflected by said first gear wheel and said first pinion;

a second pinion mounted on said first rotatable spindle;

a second rotatable spindle mounting said input-driven closing roller;

a second gear wheel mounted on said second rotatable spindle;

a second toothed belt deflecting around said second gear wheel and said second pinion; and and a motor with a spindle connected to said first pinion for driving said input-driven closing roller, said motor having a power-supply line for electrically connecting to a power supply;

said drive for said input-driven closing roller dimensioned such that an envelope transport speed in said closing module is greater than in said franking machine.

15. The configuration according to claim 14, wherein said second toothed belt and said third inclined guide plate form a wedge-shaped narrowing in an envelope transport direction toward said closing-roller pair.

16. The configuration according to claim 4, wherein:

said insert includes a side wall, a front wall containing a channel having an entry formed with a nose sloping down as a slanting plane and projecting beyond said side wall of said insert into said closing module;

said channel further has at said entry in a rear region, a supporting plate adapted to an inclination of said third inclined guide plate of said closing module;

said channel has a front top guide slope, a front bottom guide slope and a rear guide slope together defining a wedge-shaped depression bent on one side as view in a transverse profile; and said front wall having a rear side undercutting said channel.

17. The configuration according to claim 4, wherein said insert has a front wall with an adapted slit formed therein, and said depositing box has a front wall that is guided adjustably, in said adapted slit in said front wall of said insert.

18. The configuration according to claim 12, wherein said first and second spindles are inclined 1.7° in the envelope transport direction.

19. The configuration according to claim 14, wherein said envelope transport speed in said closing module is approximately 13% greater than in said franking machine.

20. The configuration according to claim 14, wherein said franking machine has a transporting belt for transporting the envelopes and a control device for controlling said transporting belt, said control device further connected to and controlling said motor of said closing module.

* * * * *